US006773488B2

(12) United States Patent
Potter

(10) Patent No.: US 6,773,488 B2
(45) Date of Patent: Aug. 10, 2004

(54) ELECTROSTATIC FILTER AND A METHOD THEREOF

(75) Inventor: Michael D. Potter, Churchville, NY (US)

(73) Assignee: Rochester Institute of Technology, Rochester, NY (US)

( * ) Notice: Subject to any disclaimer, the term of this patent is extended or adjusted under 35 U.S.C. 154(b) by 0 days.

(21) Appl. No.: 10/166,582

(22) Filed: Jun. 7, 2002

(65) Prior Publication Data

US 2002/0185003 A1 Dec. 12, 2002

Related U.S. Application Data

(60) Provisional application No. 60/297,371, filed on Jun. 11, 2001.

(51) Int. Cl.[7] ..... B03C 3/155; B03C 3/80

(52) U.S. Cl. ..... 95/59; 55/DIG. 39; 95/74; 96/50; 96/69

(58) Field of Search ..... 96/50, 69, 86–88; 95/59, 74–76; 55/DIG. 39; 307/400

(56) References Cited

U.S. PATENT DOCUMENTS

| | | | | | |
|---|---|---|---|---|---|
| 2,978,066 | A | * | 4/1961 | Nodolf | 96/87 |
| 3,487,610 | A | * | 1/1970 | Brown et al. | 55/DIG. 39 |
| 3,924,324 | A | * | 12/1975 | Kodera | 29/592.1 |
| 4,166,729 | A | * | 9/1979 | Thompson et al. | 96/86 X |
| 4,375,718 | A | * | 3/1983 | Wadsworth et al. | 55/DIG. 39 |
| 4,513,049 | A | * | 4/1985 | Yamasaki et al. | 55/DIG. 39 |
| 4,626,263 | A | * | 12/1986 | Inoue et al. | 55/DIG. 39 |
| 4,874,659 | A | * | 10/1989 | Ando et al. | 55/DIG. 39 |
| 5,057,710 | A | | 10/1991 | Nishiura et al. | 307/400 |
| 5,108,470 | A | | 4/1992 | Pick | 96/58 |
| 5,112,677 | A | * | 5/1992 | Tani et al. | 55/DIG. 39 |
| 5,256,176 | A | * | 10/1993 | Matsuura et al. | 55/DIG. 39 |
| 5,334,238 | A | * | 8/1994 | Goodson et al. | 96/50 X |
| 5,348,571 | A | * | 9/1994 | Weber | 96/87 X |
| 5,419,953 | A | * | 5/1995 | Chapman | 96/69 X |
| 5,474,599 | A | | 12/1995 | Cheney et al. | 96/55 |
| 5,496,507 | A | | 3/1996 | Angadjivand et al. | 55/528 X |
| 5,593,476 | A | | 1/1997 | Coppom | 95/78 |
| 5,593,479 | A | * | 1/1997 | Frey et al. | 96/69 X |
| 5,807,425 | A | | 9/1998 | Gibbs | 96/66 |
| 5,846,302 | A | | 12/1998 | Putro | 96/66 |
| 5,871,567 | A | | 2/1999 | Covington et al. | 96/58 |
| 5,993,520 | A | | 11/1999 | Yu | 96/66 |
| 6,119,691 | A | | 9/2000 | Angadjivand et al. | 55/DIG. 39 |
| 6,214,094 | B1 | | 4/2001 | Rousseau et al. | 96/15 |

OTHER PUBLICATIONS

A. Aguilera et al., "Electron Energy Distriubtion at the Insulator–Semiconductor Interface in AC Thin Film Electroluminescent Display Devices," *IEEE Transactions on Electron Devices*, 41:1357–1363 (1994).

S. Kobayashi et al., "Distribution of Trapped Electrons At Interface States In Actfel Devices," Proceedings of the Sixth International Workshop on Electroluminescence, El Paso, Texas, May 11–13, 1992.

* cited by examiner

*Primary Examiner*—Richard L. Chiesa
(74) *Attorney, Agent, or Firm*—Nixon Peabody LLP

(57) ABSTRACT

A filter system with a housing defining a passage between an inlet and an outlet and one or more structures located in the passage in the housing. Each of the structures comprises two or more layers of insulating materials with an imbedded fixed charge located at at least one of the interfaces between the two or more layers. At least one of the structures has an imbedded fixed charge at a charge level of at least $1\times10^{12}$ charges per $cm^2$.

23 Claims, 2 Drawing Sheets

ELECTROSTATIC FILTER AND A METHOD THEREOF

The present invention claims the benefit of U.S. Provisional Patent Application Serial No. 60/297,371, filed Jun. 11, 2001, which is hereby incorporated by reference in its entirety.

FIELD OF THE INVENTION

This invention relates generally to filters and, more particularly, an electrostatic filter and a method thereof.

BACKGROUND OF THE INVENTION

There is an increasing need for effective particle filters. One existing type of particle filter uses a filtering material with a plurality of passages or pores through which the air or gas to be filtered is passed through. If particles in the gas or air are larger than the passages or pores in the filtering material, then the particles are trapped by the filtering material. These filters are rated according to the smallest size particles that they can effectively trap.

Unfortunately, the ability to trap smaller particles requires smaller pore sizes for the filtering material which requires more energy to move the air or gas through the filter. As a result, the energy costs for filtering can become quite large when it becomes necessary to trap small particles.

Another type of particle filter is an electrostatic filter which uses an electret. The electret is a single sheet of material that holds a persistent or quasi-permanent electric charge in the sheet of material. The electrostatic filter with the electret operates by coulombic attraction between the electret and a particle or particles.

Unfortunately, there are limits on the obtainable charge in an electret. For example, U.S. Pat. No. 5,057,710 to Nishiura et al., which is herein incorporated by reference in its entirety, teaches at col 4 lines 25–29 an electret with a charge density of up to $7\times10^{-10}$ coulombs per $cm^2$ which is equivalent to a charge level of $4.4\times10^{9}$ charges per $cm^2$. In another example, U.S. Pat. No. 6,214,094 to Rousseau et al., which is herein incorporated by reference in its entirety, teaches at col. 22, lines 16–21, and FIGS. 13A and 13B an electret with a charge density of $2\times10^{-5}$ coulombs per $m^2$ which is equivalent to a charge level of $1.25\times10^{10}$ charges per $cm^2$. As a result, some of the particles in gas or air that pass through the electrostatic filter are not trapped by the electrets because the obtainable charge levels are too low.

SUMMARY OF THE INVENTION

A filter system in accordance with one embodiment of the present invention includes a housing defining a passage between an inlet and an outlet and one or more structures located in the passage in the housing. Each of the structures comprises two or more layers of insulating materials with an imbedded fixed charge located at at least one of the interfaces between the two or more layers.

A filter system in accordance with another embodiment of the present invention includes a housing defining a passage between an inlet and an outlet and one or more structures located in the passage in the housing. At least one of the structures has an imbedded fixed charge at a charge level of at least $1\times10^{12}$ charges per $cm^2$.

A method for filtering one or more particles from a fluid in accordance with another embodiment of the present invention includes moving the fluid past one or more structures. Each of the one or more structures comprises two or more layers of insulating materials with an imbedded fixed charge located at at least one of the interfaces between the two or more layers. The one or more particles are attracted to at least one of the one or more structures and are trapped against the at least one of the one or more structures.

A method for filtering one or more particles from a fluid in accordance with another embodiment of the present invention includes moving the fluid past one or more structures. Each of the one or more structures has an imbedded fixed charge at a charge level of at least $1\times10^{12}$ charges per $cm^2$. The one or more particles are attracted to at least one of the one or more structures and are trapped against the at least one of the one or more structures.

The present invention provides an electrostatic filter with lower energy requirements then prior filters. Since the passages in the filter are not restricted to the smallest size particles desired to be captured, energy requirements for moving the fluid through the filter are low. This represents a significant savings in energy cost.

The present invention also provides more effective electrostatic filter. The present invention provides a significant improvement over electrets and other materials in stored charge density. As a result, the present invention is much more effective in attracting and filtering out particles from a fluid.

The present invention also provides a filter that is easier to clean and reuse then prior filters. This represents a further cost savings to the end user of the filter.

DETAILED DESCRIPTION

Figure 1:
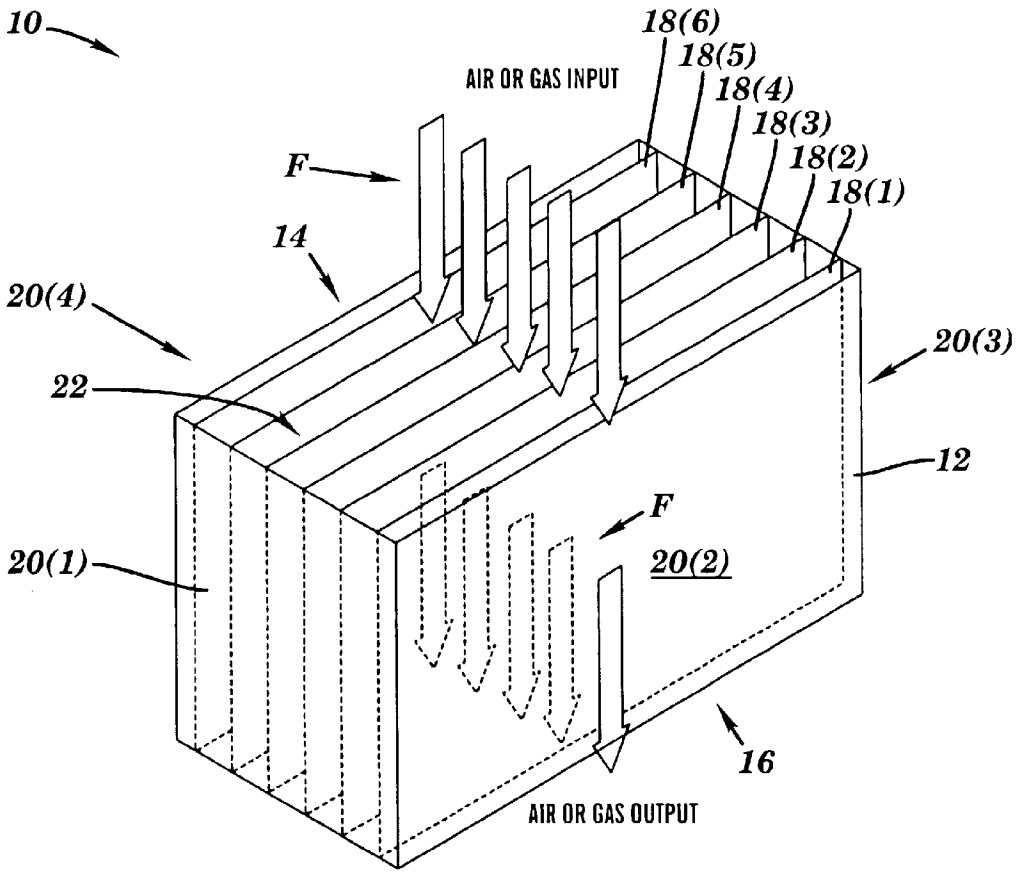
FIG. 1 is a perspective view of an electrostatic filter system in accordance with one embodiment of the present invention.
Figure 2:
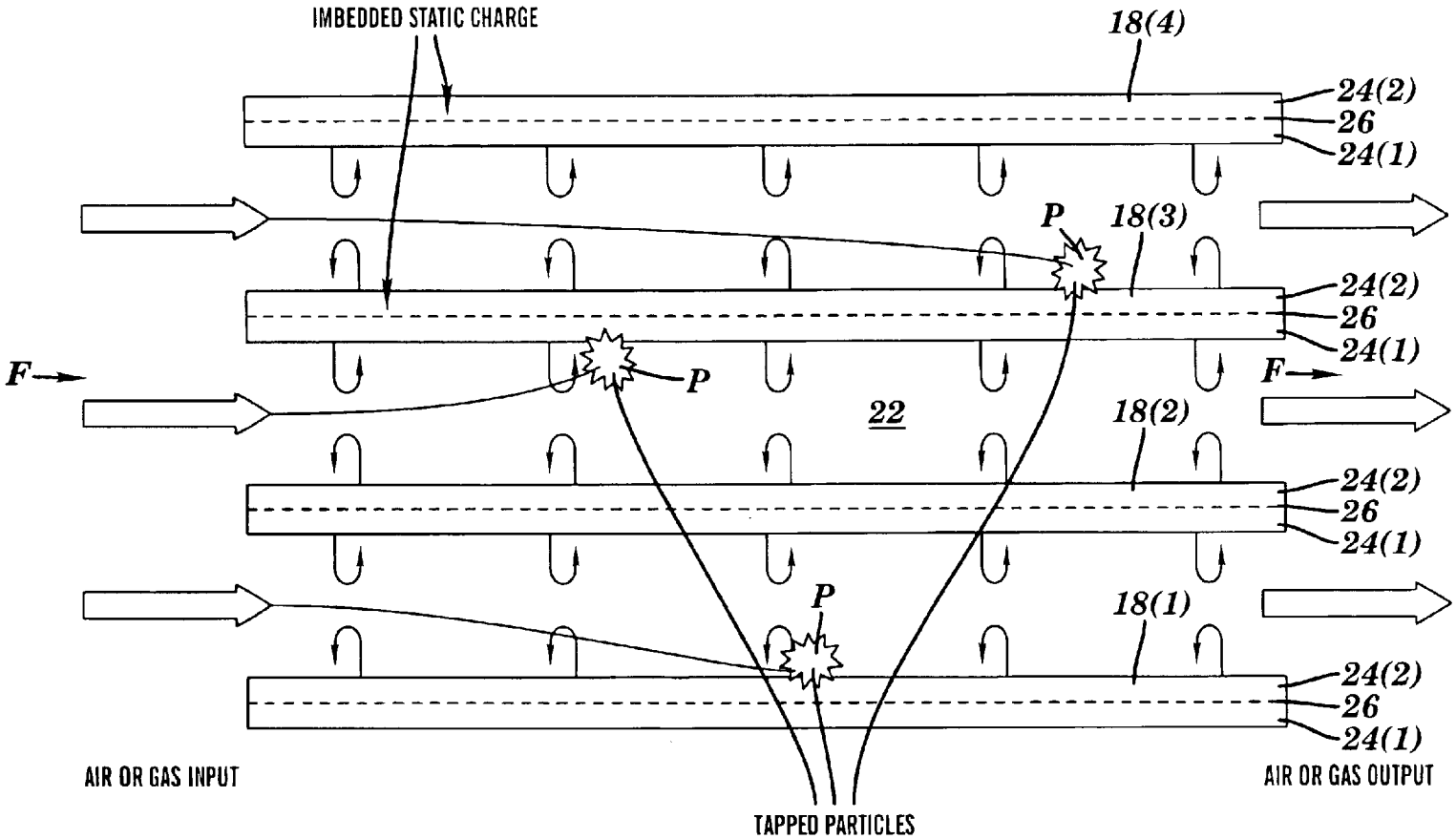
FIG. 2 is a cross-sectional view of some of the sheets with an embedded fixed charge in the electrostatic filter system shown in FIG. 1.

Referring to FIGS. 1 and 2, an electrostatic filter system 10 in accordance with one embodiment of the present invention is illustrated. The filter system 10 includes a housing 12 with an inlet 14 and an outlet 16 and a plurality of filter sheets 18(1)–18(6) with imbedded fixed static charge. The present invention provides an electrostatic filter system 10 with lower energy requirements, better fixed charge holding capabilities, better filtering capabilities, and easier cleaning then prior filters.

Referring more specifically to FIGS. 1 and 2, the housing 12 has walls 20(1)–20(4) which define a fluid passage 22 which extends between the inlet 14 and the outlet 16, although the housing 12 could have other configurations, such as a curved or a bent configuration, with other numbers of walls 20. In this particular embodiment, the passage 22 in the housing 12 extends along in substantially the same direction, although the passage 22 could have other configurations, such as a curved or a bent shape. Although a housing 12 is shown, some embodiments of the present invention do not require a housing 12, such as one with just one or more sheets 18(1)–18(6) which are placed in or adjacent a flow of fluid to be filtered.

Opposing sides of the sheets 18(1)–18(6) are connected to the walls 20(1) and 20(3) of the housing 12 in a spaced apart array, although other configurations and connections to housing 12 could be used. The sheets 18(1)–18(6) are arranged to be substantially parallel to the direction of flow of the fluid, such as air or gas, from the inlet 14 to the outlet 16 of the housing 12, although one or more of the sheets 18(1)–18(6) could be arranged in other directions with respect to the direction of flow of some or all of the fluid. The space between the sheets 18(1)–18(6) can be much larger then the size of the smallest particles to be filtered so less energy is required to move the fluid through the housing past the sheets 18(1)–18(6).

Each of the sheets 18(1)–18(6) comprises a pair of layers 24(1) and 24(2) of insulating material such a dual dielectric thin film, which are formed or connected together at an interface 26, although each of the sheets 18(1)–18(6) could comprise other numbers of layers with other numbers of interfaces depending on the number of layers. Other types of structures which can hold a fixed charge can also be used for sheets 18(1)–18(6) and these structures can have other shapes and configurations, such as a structure with fixed charge with passages in the structure for fluid to pass through and particles in the fluid to be attracted and attached to the walls of the holes. In this particular embodiment, each of the sheets 18(1)–18(6) has an embedded fixed charge at the interface 26 and an electron trap density that is optimized for a high density of states with energy levels sufficiently below the conduction band minimum for extremely long trapped charge retention times. With the present invention, practical imbedded charge levels, of at least $1\times10^{12}$ charge per $cm^2$ are easily obtainable.

By way of example only, a dual insulator for one of the sheets 18(1), 18(2), 18(3), 18(4), 18(5), or 18(6) comprising a layer 24(2) of $Al_2O_3$, although other insulators can be used, deposited on a layer 24(1) of $SiO_2$, although other insulators can be used, has a charge level of $5\times10^{12}$ charges per $cm^2$, which is about a four hundred times increase in charge density over the electret disclosed in U.S. Pat. No. 6,214,094 to Rousseau et al.

By way of another example, a sheet 18(1), 18(2), 18(3), 18(4), 18(5) with a fixed charge has a layer 24(2) of silicon nitride deposited on a layer 24(1) of silicon dioxide. The band gaps for these layers 24(1) and 24(2) of silicon nitride and silicon dioxide are approximately 5.0 eV and approximately 9.0 eV respectively. Under appropriate bias, using sacrificial electrodes, electrons tunnel into the conduction band of the layer 24(1) of silicon dioxide and drift toward the layer 24(2) of silicon nitride due to a high field. Although the band gap of silicon dioxide is very wide, the electron mobility is on the order of 1–10 $cm^2$ per volt-second. However, when the electrons arrive at the interface 26, the electrons encounter interface states with energy levels approximately 1.0 eV below the conduction band of the layer 24(2) of silicon nitride. These trap states at the interface 26 are quickly filled. The permittivity of the layer 24(2) of silicon nitride is approximately twice that of the layer 24(1) of silicon dioxide. Therefore, there is less band bending in the layer 24(2) of silicon nitride and trapped electrons do not have sufficient energy to tunnel into the conduction band of the layer 24(2) of silicon nitride, i.e., the traps are filled and remain filled. Once the electrical bias is removed, reverse tunneling is possible as long as the stored charge is sufficient to cause a band bending great enough for emptying a trap to the conduction band of the layer 24(1) of silicon dioxide conduction band. Taking into account filled trap densities, permittivities, and each component film thickness, a high level of trapped static charge is achievable in this particular example.

A method for making the filter system 10 will be described with reference to FIGS. 1 and 2. The sheets 18(1)–18(6) are each fabricated. A layer 24(2) of insulating material is deposited on another layer of insulating material 24(1). Next, a fixed charge is imbedded in each of the sheets 18(1)–18(6) and is held at an interface 26 for each of the sheets 18(1)–18(6). A variety of techniques for imbedding the charge can be used, such as by applying a sufficient electrical bias across the layers 24(1) and 24(2) by utilizing conducting electrodes and conducting sacrificial layers on opposing sides of layers 24(1) and 24(2) or by injecting the electrons into the layers 24(1) and 24(2) to the interface 26 with an electron gun.

The sheets 18(1)–18(6) are secured at opposing sides to an interior portion of the housing 12. The sheets 18(1)–18(6) are arranged in an equally spaced apart array along the passage 22.

The operation of the filter system 10 will be described with reference to FIGS. 1 and 2. A fluid F, such as air, gas or a liquid, is directed into the inlet 14 of the housing 12. The fluid F travels along the passage 22 in the housing 12 towards the outlet 16. As the fluid F travels down the passage 22, the fluid F passes by the sheets 18(1)–18(6) with imbedded fixed charge at the interface 26.

Due to random and chaotic motion of any particle P in the fluid, air or gas, the particle is attracted to a nearest sheet 18(1), 18(2), 18(3), 18(4), 18(5), or 18(6) with imbedded static charge due to an induced charge in the particle P. If the particle P is a conductive particle, the induced charge is easily created. If the particle P is insulating in nature, the induced charge is a result of induced dipoles. In either case, the particle P will be strongly attracted to a charge imbedded sheet 18(1), 18(2), 18(3), 18(4), 18(5), or 18(6). Because the electrostatic attraction is effective for a tremendous range of particle size, the spacing between the sheets 18(1)–18(6) need not be highly restrictive to air or gas flow. This results in a very significant energy savings and reduction in the overall cost of maintaining a highly effective air or gas filtering system. Furthermore, the electrostatic filter 10 described herein is a passive filter, i.e. the filter itself requires no power.

By choosing the appropriate charge density and materials properties, the filter 10 can be cleaned by placing them, for example, in a fluid flow cleaner system with sufficient flow. To dislodge the particles, the force due to the fluid flow on the attracted and attached particles P is greater than the electrostatic attraction forces. Therefore, the trapped particle P is dislodged and flushed away and the filter 10 is cleaned and ready for further filtering service.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefor, is not intended to limit the claimed processes to any order except as may be specified in the claims. Accordingly, the invention is limited only by the following claims and equivalents thereto.

What is claimed is:

1. A filter system comprising one or more structures, wherein each of the structures comprises two or more layers of insulating materials with an imbedded fixed charge located at at least one of the interfaces between the two or more layers, wherein each of the one or more structures with the imbedded fixed charge is a monopole structure.

2. The system as set forth in claim 1 further comprising a housing defining a passage between an inlet and an outlet, one or more of the structures located in the passage in the housing.

3. The system as set forth in claim 1 wherein at least one of the one or more structures is substantially parallel to a direction of the flow of fluid through the housing.

4. The system as set forth in claim 1 further comprising a plurality of the one or more structures.

5. The system as set forth in claim 4 wherein the plurality of structures are spaced substantially the same distance apart from each other in the housing.

6. The system as set forth in claim 1 wherein the imbedded fixed charge has a charge level of at least $1\times10^{12}$ charges per $cm^2$.

7. A filter system comprising one or more structures located in a passage in a housing, at least one of the structures has an imbedded fixed charge at a charge level of at least $1\times10^{12}$ charges per $cm^2$, wherein each of the one or more structures with the imbedded fixed charge is a monopole structure.

8. The system as set forth in claim 7 further comprising a housing defining a passage between an inlet and an outlet, one or more of the structures located in the passage in the housing.

9. The system as set forth in claim 7 wherein each of the structures comprises two or more layers with the imbedded fixed charge located at one or more of the interfaces between the two or more layers.

10. The system as set forth in claim 7 wherein at least one of the one or more structures is substantially parallel to a direction of the flow of fluid through the housing.

11. The system as set forth in claim 7 further comprising a plurality of the one or more structures.

12. The system as set forth in claim 11 wherein the plurality of structures are spaced substantially the same distance apart from each other in the housing.

13. A method for filtering one or more particles from a fluid, the method comprising:

moving the fluid past one or more structures, wherein each of the one or more structures comprises two or more layers of insulating materials with an imbedded fixed charge located at at least one of the interfaces between the two or more layers, wherein each of the one or more structures with the imbedded fixed charge is a monopole structure;

attracting the one or more particles to at least one of the one or more structures; and trapping the one or more particles against the at least one of the one or more structures.

14. The method as set forth in claim 13 further comprising placing at least one of the one or more structures in a substantially parallel direction to a direction of the moving fluid.

15. The method as set forth in claim 13 wherein the moving the fluid is past a plurality of the one or more structures.

16. The filter method as set forth in claim 13 further comprising placing each of the plurality of structures substantially the same distance apart from each other in the housing.

17. The method as set forth in claim 13 wherein the imbedded fixed charge has a charge level of at least $1\times10^{12}$ charges per $cm^2$.

18. The method as set forth in claim 13 further comprising:

forcing another fluid past the one or more structures; and dislodging the one or more particles from the one or more structures with the forced fluid.

19. A method for filtering one or more particles from a fluid, the method comprising:

moving the fluid past one or more structures, wherein each of the one or more structures has an imbedded fixed charge at a charge level of at least $1\times10^{12}$ charges per $cm^2$ and wherein each of the one or more structures with the imbedded fixed charge is a monopole structure;

attracting the one or more particles to at least one of the one or more structures; and trapping the one or more particles against the at least one of the one or more structures.

20. The method as set forth in claim 19 further comprising placing at least one of the one or more structures in a substantially parallel direction to a direction of the moving fluid.

21. The method as set forth in claim 19 wherein the moving the fluid is past a plurality of the one or more structures.

22. The filter method as set forth in claim 19 further comprising placing each of the plurality of structures substantially the same distance apart from each other in the housing.

23. The method as set forth in claim 19 further comprising forcing another fluid past the one or more structures; and dislodging the one or more particles from the one or more structures with the forced fluid.

* * * * *